US010944228B2

(12) United States Patent
Steinberg et al.

(10) Patent No.: US 10,944,228 B2
(45) Date of Patent: Mar. 9, 2021

(54) METHOD FOR ATTACHING A CONTACT ELEMENT TO THE END OF AN ELECTRICAL CONDUCTOR

(71) Applicant: NEXANS, Courbevoie (FR)

(72) Inventors: Helmut Steinberg, Störnstein (DE); Rudolf Derntl, Grafing (DE)

(73) Assignee: NEXANS, Courbevoie (FR)

( * ) Notice: Subject to any disclaimer, the term of this patent is extended or adjusted under 35 U.S.C. 154(b) by 195 days.

(21) Appl. No.: 15/813,805

(22) Filed: Nov. 15, 2017

(65) Prior Publication Data

US 2018/0138648 A1 May 17, 2018

(30) Foreign Application Priority Data

Nov. 17, 2016 (EP) ..... 16306498

(51) Int. Cl.

| | |
|---|---|
| ***H01R 43/04*** | (2006.01) |
| ***H01R 43/16*** | (2006.01) |
| ***C23C 24/04*** | (2006.01) |
| ***H01R 13/02*** | (2006.01) |
| ***B22F 7/08*** | (2006.01) |
| *H01R 4/62* | (2006.01) |
| *H01R 43/28* | (2006.01) |
| *H01R 11/11* | (2006.01) |

(52) U.S. Cl.

CPC ..... *H01R 43/16* (2013.01); *B22F 7/08* (2013.01); *C23C 24/04* (2013.01); *H01R 13/025* (2013.01); *B22F 2999/00* (2013.01); *H01R 4/62* (2013.01); *H01R 11/11* (2013.01); *H01R 43/28* (2013.01)

(58) Field of Classification Search

CPC ..... H01R 43/16; H01R 4/62; H01R 11/11; H01R 13/025; H01R 43/28; C23C 24/04; B22F 7/08; B22F 3/168

See application file for complete search history.

(56) References Cited

U.S. PATENT DOCUMENTS 4,775,337 A 10/1988 Van Wagener
5,191,710 A * 3/1993 Fujimaki ..... H01R 11/12 174/15.7

(Continued)

FOREIGN PATENT DOCUMENTS

CH 707565 8/2014

OTHER PUBLICATIONS

International Search Report dated Jan. 16, 2017.

*Primary Examiner* — Paul D Kim
(74) *Attorney, Agent, or Firm* — Sofer & Haroun, LLP

(57) ABSTRACT

A method for attaching a contact element to the end of an electrical conductor is provided. In the method electrically conductive material is shaped to form a contact element with a variable shape. The end of the bare conductor is firstly moved into an at least approximately vertical position. Particles of an electrically conductive material are then applied at a high speed to the upwardly projecting front-side end of the conductor in the axial direction thereof that the material of the conductor connects to the electrically conductive material to form a compact structure which is connected to the material of the conductor in a mechanically fixed and electrically conductive fashion. Additional particles of the electrically conductive material are applied to the compact structure, and the metal body is shaped mechanically to form the contact element.

3 Claims, 2 Drawing Sheets

(56) References Cited

U.S. PATENT DOCUMENTS

| | | | | |
|---|---|---|---|---|
| 5,960,540 | A | 10/1999 | Pentz | |
| 7,413,488 | B2 * | 8/2008 | Matsumura | H01H 85/044 439/874 |
| 9,590,324 | B2 * | 3/2017 | Koda | H01R 11/12 |
| 9,793,626 | B2 * | 10/2017 | Koda | H01R 43/28 |
| 2013/0072075 | A1 | 3/2013 | Kayamoto | |

* cited by examiner

METHOD FOR ATTACHING A CONTACT ELEMENT TO THE END OF AN ELECTRICAL CONDUCTOR

RELATED

This application is related to and claims the benefit of priority from European Patent Application No. 16 306 498.3, Nov. 17, 2016, the entirety of which is incorporated by reference.

BACKGROUND

Field of Invention

The invention relates to a method for attaching a contact element to the end of an electrical conductor, by which electrically conductive material which is present at the end of the conductor and is fixedly connected to the conductor is shaped to form a contact element with a variable shape (DE 2 325 294 A).

Description of the Related Art

Methods for attaching contact elements to the ends of electrical conductors or lines have been known for a long time. In order to produce an effective electrical connection between a contact element and a conductor, the same surrounding insulating layers are firstly removed from the conductor. A contact element can then be connected to the conductor using a known technology, for example by means of screws or clamps or by welding or soldering or by crimping. At the connecting point, the lowest possible electrical transmission resistance between the contact element and the conductor is significant. Furthermore, a fixed seat of the contact element on the conductor is to be permanently ensured.

DE 2 325 294 A, which is mentioned at the beginning, discloses a method for generating a contact element at the end of an electrical conductor which does not require mechanical fastening elements. With this method, the end of an electrical conductor is heated in such a way that the material thereof melts. In this context, a corresponding arrangement of the conductor prevents the molten material of the conductor from dripping therefrom. As a result, said metal becomes a pear-shaped mass, referred to as a "clump", which is a fixed component of the conductor. The clump is subsequently mechanically shaped to form a contact element, which can be carried out differently in any desired manner. In this known method, the material of the conductor itself is thus used to form a contact element. As a result, the method is restricted to the material of the conductor.

OBJECTS AND SUMMARY

The invention is based on the object of developing the method described at the beginning in such a way that it can be used for any desired materials of conductor and contact element.

This object is achieved according to the invention in that the end of the bare conductor is firstly moved into an at least approximately vertical position, in that particles of an electrically conductive material are then applied at such a high speed to the upwardly projecting front-side end of the conductor in the axial direction thereof that the material of the conductor connects to the electrically conductive material to form a compact structure which is connected to the material of the conductor in a mechanically fixed and electrically conductive fashion, in that, in order to form a metal body without interrupting the method, further particles of the electrically conductive material are subsequently applied to the compact structure, and in that the metal body is finally shaped mechanically to form the contact element.

This method, which is also referred to in the technical world as "gas dynamic cold spraying", operates purely mechanically without feeding in heat to the conductor. The particles of the electrically conductive material—referred to below only as "particles" for short—are advantageously fed to the front side of the conductor via a pipe which acts as a nozzle, and specifically by means of a gas stream which serves as a carrier and, together with the particles contained therein, impinges at high speed on the front side of the conductor. An inert gas is preferably used as gas. The particles which consist for example of copper penetrate the material of the conductor because of the high speed, which can advantageously be above the speed of sound, and connect themselves thereto metallurgically to form a compact structure which contains the material of the conductor and the material of the particles. This structure, referred to below as "composite body", is as a result electrically conductively connected to the material of the conductor, with the result that the entire conductive cross section of the conductor is included. This is highly important, for example, if the conductor is a stranded conductor composed of a plurality of wires which consist, for example, of aluminium or an aluminium alloy. Since the method is continued without interruption, particles also impinge on the composite body, as a result of which a metal body which points away from the conductor is gradually applied to the composite body. The method is ended when the metal body has sufficient material to form an electrical contact element.

The conductor is advantageously arranged vertically in order to carry out the method, with the result that its front side is accessible from above. The particles then advantageously impinge in a surface-normal fashion on the front side of the conductor. In this context, low angular deviations from the surface normal may be permissible. Particles which do not impinge on the front side of the conductor, but are rather moved past the conductor in the axial direction thereof, do not adhere to the surface of the conductor.

As already mentioned, a pipe which acts as a nozzle is advantageously used to feed the particles, which can also be powder particles. Such a pipe can have, in its length, a constriction which gives the gas stream loaded with the particles the necessary high speed. In one preferred embodiment, a basically known "Laval nozzle" is used as the pipe.

The method can be used for all metallic materials which are suitable as electrical conductors, on the one hand, and as electrical contact elements, on the other. It is particularly advantageous here that for the conductor and for the contact element which is to be generated it is also possible to use different metals which are connected in a metallurgically fixed fashion to form one unit. Effects of corrosion on a contact point can be excluded when this method is used. The electrical transmission resistance between conductor and contact element is negligible, even if different materials are used for both parts.

In the described sense, the conductor can consist, for example, of aluminium, and the contact element of copper, or vice-versa. This also applies to alloys of these two materials. It is, for example, also possible to use brass, particularly advantageously for the contact element. However, it is also possible for the conductor and the contact element to each use the same material.

BRIEF DESCRIPTION OF THE DRAWINGS

The method according to the invention will be explained as an exemplary embodiment with reference to the drawings, in which.

DETAILED DESCRIPTION

Figure 1:
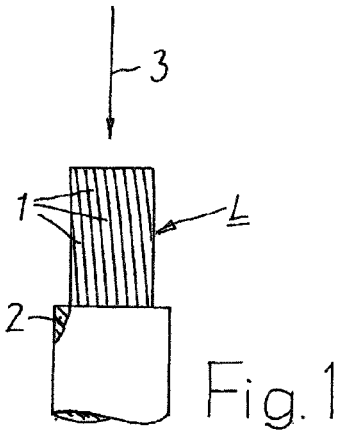
FIG. 1 shows the end of an electrical conductor with the insulation removed.

In FIG. 1, the end of an insulated electrical conductor L is shown which is embodied in the illustrated exemplary embodiment as a stranded conductor which comprises a plurality of individual wires 1. The conductor can, however, also be a solid conductor. Insulation 2 which surrounds the conductor L is removed therefrom at its end. Particles of electrically conductive material are applied to the front side of the conductor L, in its axial direction corresponding to the arrow 3, at a high speed which is advantageously higher than the speed of sound. The corresponding method will be further explained below in more detail with reference to FIG. 3.

Figure 2:
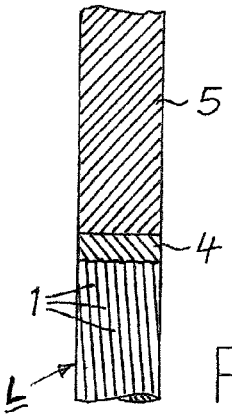
FIG. 2 shows the end of the conductor according to FIG. 1 after processing with the method according to the invention.

The method according to the invention at first is used to generate, at the end of the conductor L, a compact structure which is indicated in FIG. 2 and illustrated as a composite body 4 which is shown in hatched form and is composed of the material of the conductor L, on the one hand, and, on the other hand, of the metal which is applied by the particles and is connected in a metallurgically fixed fashion to the material of the conductor L in the composite body 4.

In addition, a metal body 5 which consists only of the material of the particles is generated on the composite body 4 by the particles of the electrically conductive material which further impinge on said composite body 4. Said metal body 5 is connected in a metallurgically fixed fashion to the composite body 4. The metal body 5 is shown in FIG. 2 with a different hatching from that of the composite body 4.

The method according to the invention is carried out, for example, as follows:

In order to feed, for example, particles which consist advantageously of copper—referred to below for short as "particles"- to a conductor L which consists, for example, of aluminium, a pipe 6 which acts as a nozzle is used which is arranged in the axial direction of the conductor L which is arranged with a vertical profile, above said conductor L. Gas coming from a gas source 7, advantageously an inert gas, is blown as a gas stream into the pipe 6, at its one end, from a gas source 7. Particles, which are contained in a reservoir 8 of particles, are fed into the gas stream before it enters into the pipe 6. The gas stream can be passed through the particles. However, in any case, the particles are arranged in such a way that they are picked up and transported by the gas stream.

The conductor L is advantageously arranged in a tool 9 in such a way that only its tip projects out of the latter. The tool 9 holds together the wires 1 of the conductor L, if the latter is a stranded conductor, and protects the insulation 2 of the conductor L with respect to the particles. The tool 9 can advantageously consist of multiple parts. The gas stream 10 which is loaded with the particles exits the pipe 6 at the free end thereof at a high speed which is advantageously higher than the speed of sound. Said gas stream impinges on the front side of the conductor L. The gas stream 10 therefore has the function of a carrier for the particles which as a result impinge on the front side of the conductor L at the same speed as the gas. The metal body 5 which has already been described and which also encompasses the composite body 4 is generated by the particles.

Figure 3:
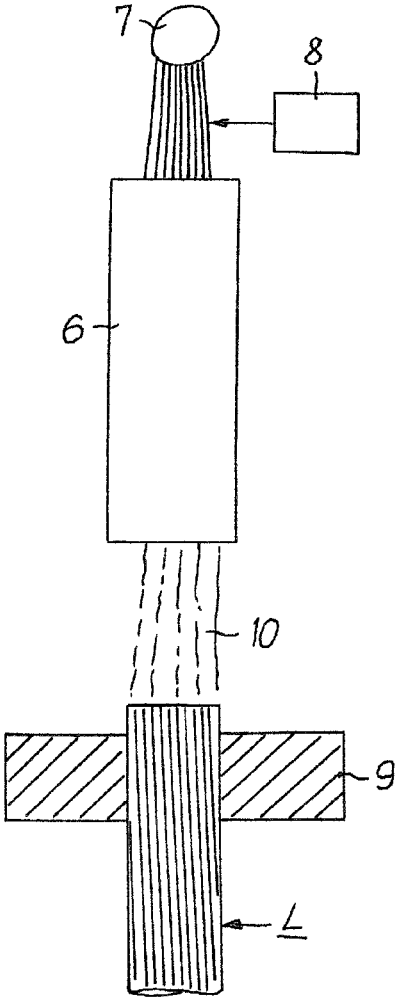
FIG. 3 shows a schematic illustration of an arrangement for carrying out the method according to the invention.

The pipe 6 is positioned at a distance from the front side of the conductor L in accordance with FIG. 3. The distance is variable. It depends on the material of the particles and is preferably between 20 mm and 105 mm.

Figure 4:
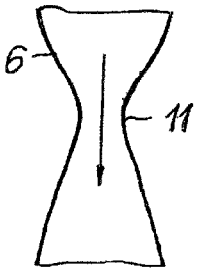
FIG. 4 shows a pipe which can be used in the method according to the invention.

The pipe 6 which has an overall circular cross section can have, in its length corresponding to the purely schematic illustration in FIG. 4, a constriction 11 of its clear cross section, as a result of which the required speed of the gas stream and therefore the required speed of the particles can be achieved in accordance with the function of the above mentioned Laval nozzle.

Figure 5:
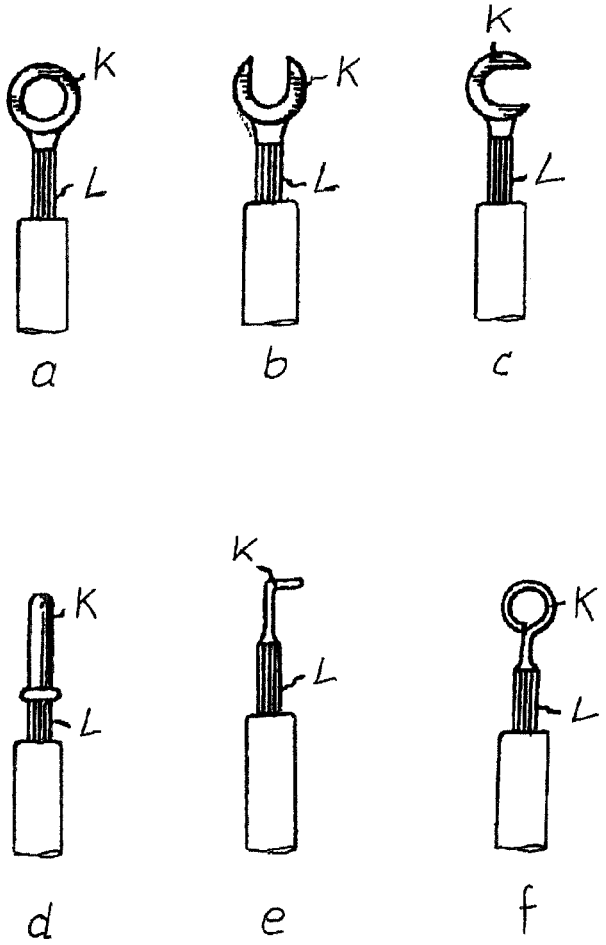
FIG. 5 shows different contact elements which can be produced with the method according to the invention.

After the method ends, the conductor L is connected at its end in a metallurgically fixed fashion to the metal body 5, and specifically in the junction region with the compact structure which is referred to above as "composite body 4". The metal body 5 which also contains the composite body 4 can then be shaped mechanically to form a contact element K with any desired shape for different applications. Six examples of possible contact elements K are shown schematically in FIGS. 5*a* to 5*d*. The contact element K according to FIG. 5*a* can be used, for example, as a connection to the pole of a battery as what is referred to as a battery terminal. For example, a contact element K which is embodied as a plug pin is represented in FIG. 5*d*.

The invention claimed is:

1. Method for making a contact element at the end of an electrical conductor, where electrically conductive material which is present at the end of the conductor and which is fixedly connected to the conductor is shaped to form the contact element, the contact element having a variable shape, said method comprising the steps of:

moving a bare front-side of the conductor into a vertical position relative to a ground surface, such that said bare-front side is accessible from above;

applying particles of the electrically conductive material downwardly, at a supersonic speed, to the upwardly projecting bare front-side end of the conductor in an axial direction thereof from a likewise vertically arranged pipe which acts as a nozzle, sufficient that a material of the conductor connects with the electrically conductive material from said pipe forming a compact surface-normal structure which is connected to the material of the conductor in a mechanically fixed and electrically conductive fashion, wherein said pipe includes a constriction for obtaining said supersonic speed of said electrically conductive particles;

without interruption, continuing to apply additional particles of electrically conductive material to the compact structure forming a metal body; and mechanically shaping the metal body to form the contact element.

2. The method according to claim 1, wherein the conductor is used which is constructed from a plurality of wires which are combined to form one unit and which consist of aluminium or of an aluminium alloy.

3. The method according to claim 1, wherein a copper or a copper alloy is used as a material for the particles.

* * * * *